US007802679B2

(12) United States Patent
Rhee

(10) Patent No.: US 7,802,679 B2
(45) Date of Patent: Sep. 28, 2010

(54) GOLF BAG HAVING BOTTOM UNIT DIAGONALLY ATTACHED TO INCLINED END OF BAG BODY

(75) Inventor: Yong Su Rhee, Seoul (KR)

(73) Assignee: Jason Industries Co., Ltd., Seoul (KR)

( * ) Notice: Subject to any disclaimer, the term of this patent is extended or adjusted under 35 U.S.C. 154(b) by 1116 days.

(21) Appl. No.: 11/401,859

(22) Filed: Apr. 12, 2006

(65) Prior Publication Data

US 2006/0231435 A1 Oct. 19, 2006

(30) Foreign Application Priority Data

Apr. 15, 2005 (KR) ..... 10-2005-0031247

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS

| | | | | |
|---|---|---|---|---|
| 1,659,269 | A * | 2/1928 | Hotze | 206/315.7 |
| 4,676,464 | A | 6/1987 | Reimers | 248/96 |
| 4,834,235 | A | 5/1989 | Solheim et al. | 206/315.7 |
| 4,921,192 | A * | 5/1990 | Jones | 248/96 |
| 5,390,788 | A | 2/1995 | Schenkkan | 206/315.7 |
| 5,996,789 | A | 12/1999 | Suggs et al. | 206/315.3 |
| 6,443,405 | B1 * | 9/2002 | Han | 248/96 |
| 6,474,606 | B1 | 11/2002 | Cheng | 248/96 |
| 6,766,905 | B1 | 7/2004 | Chang | 206/315.7 |
| 2002/0000500 | A1 | 1/2002 | Lin | 248/96 |
| 2002/0195360 | A1 * | 12/2002 | Hsieh | 206/315.7 |
| 2005/0072696 | A1 | 4/2005 | Yang | 206/315.7 |

* cited by examiner

*Primary Examiner*—Tri M Mai
(74) *Attorney, Agent, or Firm*—Jacobson Holman PLLC

(57) ABSTRACT

A golf bag having a bottom unit diagonally attached to an inclined end of an elongated bag body is disclosed. The golf bag includes a bag body having a lower end diagonally inclined rearwards and upwards. A bottom unit is attached along the diagonally inclined lower end of the bag body such that the bottom unit is diagonally inclined relative to the axis of the bag body, with a hook protrusion provided on the lower part of the outer surface of a rear part of the bottom unit. A front support rib is installed in a front part of the bag body such that the upper end of the front support rib is held in a rib support hole provided in the head of the bag body and the lower end of the front support rib is held in a rib support piece provided in the bag body. The golf bag also includes a pair of support legs coupled to the rear part of the upper end of the golf bag, a leg actuating arm coupled to the support legs so as to extend or collapse the legs, and an arm holding flap attached to the rear part of the bag body so as to hold the lower part of the leg actuating arm.

10 Claims, 6 Drawing Sheets

GOLF BAG HAVING BOTTOM UNIT DIAGONALLY ATTACHED TO INCLINED END OF BAG BODY

BACKGROUND OF THE INVENTION

1. Field of the Invention

The present invention relates, in general, to a golf bag having a bottom unit diagonally attached to an inclined lower end of an elongated bag body and, more particularly, to a golf bag, in which: a bag body is configured such that the front part of the bag body is longer than the rear part, so that the lower end of the bag body is diagonally inclined forwards and downwards at an angle of inclination equal to or greater than a rearward leaning angle of the golf bag when the golf bag is placed on a support surface; a bottom unit is attached to the diagonally inclined lower end of the bag body such that the bottom unit is diagonally inclined relative to the axis of the bag body, with a hook protrusion provided on the lower part of the outer surface of the rear part of the bottom unit; a front support rib, having a length shorter than the length of either the front or rear part of the bag body, is installed on the front part of the bag body; a pair of support legs is coupled to the rear part of the upper end of the golf bag; a leg actuating arm is coupled to the support legs so as to extend or collapse the legs; and an arm holding flap is attached to the rear part of the bag body so as to hold the lower part of the leg actuating arm. In the golf bag, because the bottom unit is attached to the diagonally inclined lower end of the elongated bag body, the bottom unit is diagonally inclined relative to the axis of the bag body, so that, when the golf bag is put down on a support surface, the lower surface of the bottom unit comes into horizontal contact with the support surface, while the bag body leans rearwards at a leaning angle and can be maintained in the rearward leaning state by the support legs.

2. Description of the Related Art

An example of conventional golf bags having bottom units diagonally attached to inclined ends of elongated bag bodies is disclosed in U.S. Pat. No. 4,676,464 (herein below, referred to simply as the first cited reference). The conventional golf bag disclosed in the first cited reference is configured such that the lower surface of a bottom unit of the golf bag can be horizontally placed on a support surface, but the action for extending or collapsing a pair of support legs is executed using an actuating rope connected to both a shoulder strap and the support legs. Furthermore, the sidewall of the bottom unit of the golf bag leans at the same leaning angle as that of the bag body.

Another example of conventional golf bags having bottom units diagonally attached to inclined ends of elongated bag bodies is disclosed in U.S. Pat. No. 5,390,788 (herein below, referred to simply as the second cited reference). In the same manner as that described for the first cited reference, the golf bag disclosed in the second cited reference is configured such that the lower surface of a bottom unit comes into horizontal contact with a support surface and the action for extending or collapsing a pair of support legs is executed using an actuating rope connected to both a shoulder strap and the support legs. However, in the second cited reference, the actuating rope is connected to both the shoulder strap and the legs by a handle, unlike the first cited reference. Furthermore, the sidewall of the bottom unit of the golf bag leans at the same leaning angle as that of the bag body in the same manner as that described for the first cited reference.

Furthermore, U.S. Pat. No. 4,834,235 (herein below, referred to simply as the third cited reference) discloses a golf bag in which the lower surface of a bottom unit is horizontally placed on a support surface in the same manner as those described for the first and second cited references. However, unlike the first and second cited references, the golf bag disclosed in the third cited reference does not use any actuating rope connected to the shoulder strap and the support legs to extend or collapse the support legs. To extend or collapse the support legs, the golf bag is inclined in the direction of the legs and, at the same time, the jointed position, at which the upper ends of the support legs are jointed to the rear part of the top of the golf bag, is moved downwards, and a leg actuating arm coupled by a hinge to the upper ends of the support legs is pressurized downwards at a contact part thereof at which the leg actuating arm comes into contact with a support surface, so that the upper end of the leg actuating arm jointed to the support legs is biased upwards, thus extending the legs outwards.

U.S. Pat. No. 5,996,789 (herein below, referred to simply as the fourth cited reference) discloses a golf bag in which the lower surface of a bottom unit comes into horizontal contact with a support surface in the same manner as described for the first and second cited references. However, unlike the first and second cited references, the golf bag disclosed in the fourth cited reference does not use any actuating rope, which is connected to both the shoulder strap and the support legs, to extend or collapse the support legs. To extend or collapse the support legs, the golf bag is inclined in the direction of the legs and, at the same time, the jointed position, at which the upper ends of the support legs are jointed to the rear part of the top of the golf bag, is moved downwards, and a leg actuating arm coupled by a hinge to the upper ends of the support legs is pressurized downwards at a contact part thereof at which the leg actuating arm comes into contact with a support surface, so that the upper end of the leg actuating arm jointed to the support legs is biased upwards, thus extending the legs outwards. Described in detail, when the golf bag disclosed in the fourth cited reference is inclined in the direction having the legs, the lower end of the rear part of the bag body having the legs is folded and collapsed with wrinkles, so that the leg actuating arm pushes the jointed upper ends of the support legs outwards, thus extending the legs in the same manner as that described for the third cited reference. The third and fourth cited references are equal to each other in which, when the golf bag leans in the direction of the legs, the lower end of the rear part of the bag body having the legs is folded and collapsed with wrinkles, so that the leg actuating arm pushes the jointed upper ends of the support legs outwards, thus extending the legs. However, unlike the third cited reference, using a conventional bottom unit having a constant height, the fourth cited reference uses a specifically constructed bottom unit, in which the front part of the sidewall is higher than the rear part, thus forming a trapezoidal cross-section. In the golf bag of the fourth cited reference, the lower surface of the bottom unit forms a horizontal surface, while the upper end of the bottom unit is inclined downwards and rearwards. Furthermore, in the fourth cited reference, a surplus bottom structure having a triangular cross-section is provided on the rear part of the lower surface of the bottom unit, so that, when the golf bag leans rearwards, the front part of the bottom unit is not undesirably raised upwards. Furthermore, the general function and general construction of the golf bag disclosed in the fourth cited reference remain the same as those described for the third cited reference, however, the bottom units of the golf bags disclosed in the third and fourth cited references have different shapes. The bag bodies of the third and fourth cited references necessarily have different shapes, which vary according to the shapes of the bottom units.

SUMMARY OF THE INVENTION

Accordingly, the present invention has been made keeping in mind the above problems occurring in the related art, and an object of the present invention is to provide a golf bag, which includes a bag body having a lower end diagonally inclined forwards and downwards, a bottom unit attached along the diagonally inclined lower end of the bag body such that the bottom unit is diagonally inclined relative to the axis of the bag body, and a front support rib having a length shorter than each of the front and rear parts of the bag body and installed in the front part of the bag body, so that, when the golf bag is put down on a support surface, the front part of the bottom unit comes into contact with the support surface before the rear part of the bottom unit due to the weight of the golf bag, golf clubs, golf balls and other necessities stored in the golf bag, thereby the lower end of the front part of the bag body is thus folded and collapsed with wrinkles, and, thereafter, the entire lower surface of the bottom unit comes into horizontal contact with the support surface and, at that time, the lower end of the leg actuating arm comes into contact with the support surface, so that a reaction force is applied to the hinge of the leg actuating arm relative to the support legs, thus extending the legs outwards, and the collapsed front part of the bag body is automatically smoothed, so that the golf bag can stably stand on a support surface and allow a golfer to easily and conveniently use the golf bag.

In order to achieve the above object, according to one aspect of the present invention, there is provided a golf bag, comprising: a bag body having a lower end diagonally inclined rearwards and upwards; a bottom unit attached along the diagonally inclined lower end of the bag body such that the bottom unit is diagonally inclined relative to an axis of the bag body, with a hook protrusion provided on a lower part of an outer surface of a rear part of the bottom unit; a front support rib installed in a front part of the bag body such that an upper end of the front support rib is held in a rib support hole provided in a head of the bag body and a lower end of the front support rib is held in a rib support piece provided in the bag body; a pair of support legs coupled to a rear part of the upper end of the golf bag; a leg actuating arm coupled to the support legs so as to extend or collapse the legs; and an arm holding flap attached to the rear part of the bag body at a predetermined position so as to hold a lower part of the leg actuating arm.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
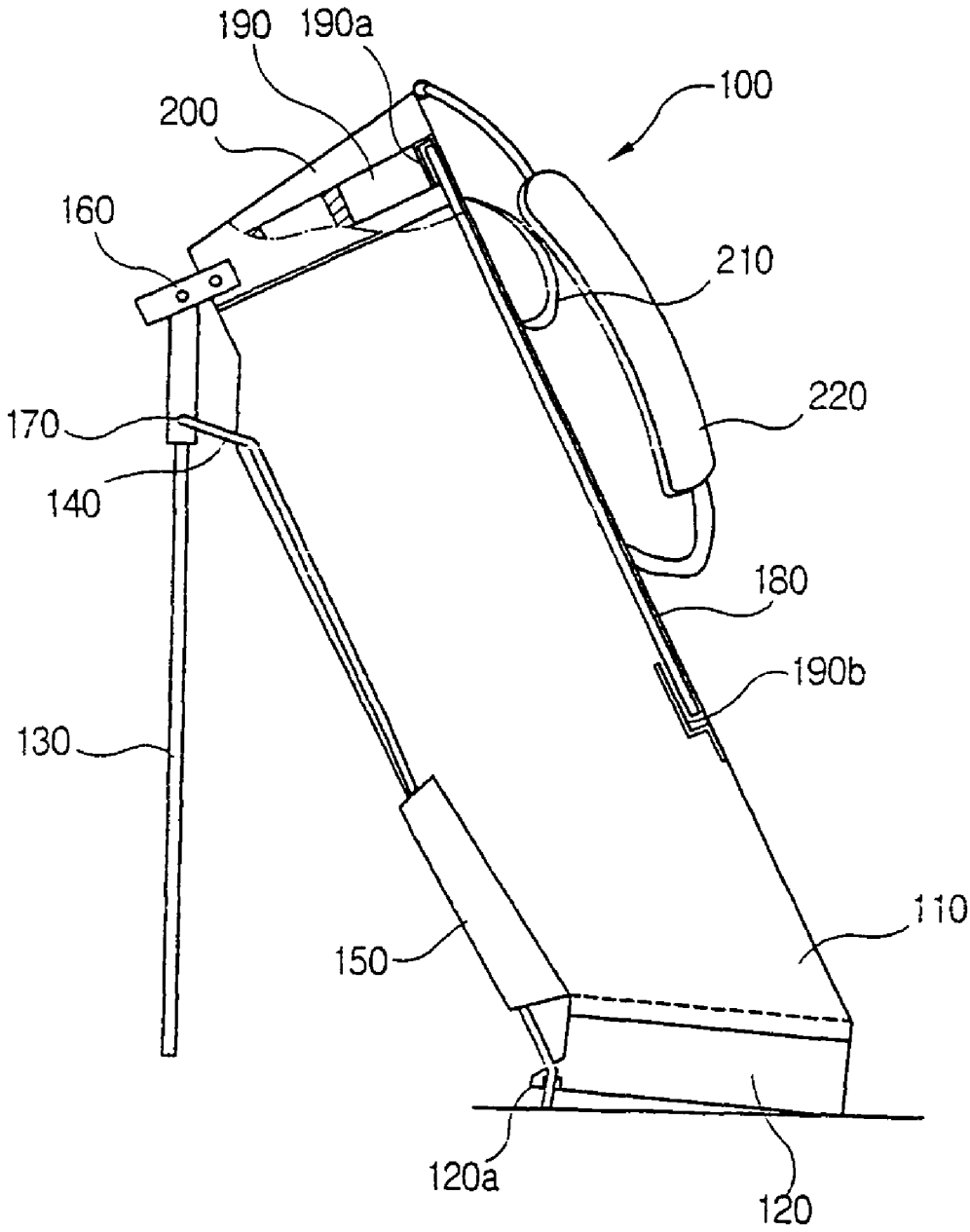
FIG. 1 is a side view of a golf bag according to the present invention, which is in an intermediate state in which a pair of support legs of the golf bag is not fully extended, but in which the lower end of a leg actuating arm comes into contact with a support surface while the golf bag is leaning rearwards.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2A:
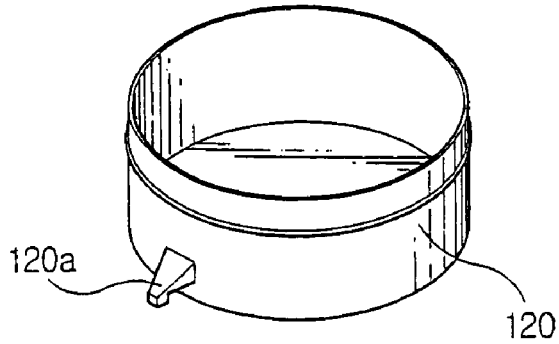
FIG. 2A is a perspective view of a bottom unit of the golf bag according to the present invention.
Figure 2B:
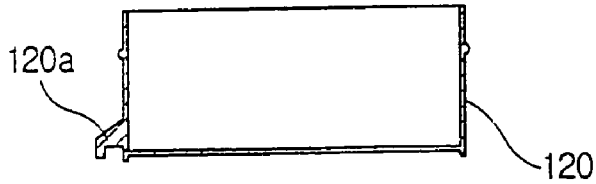
FIG. 2B is a sectional view of the bottom unit of the golf bag according to the present invention.
Figure 3:
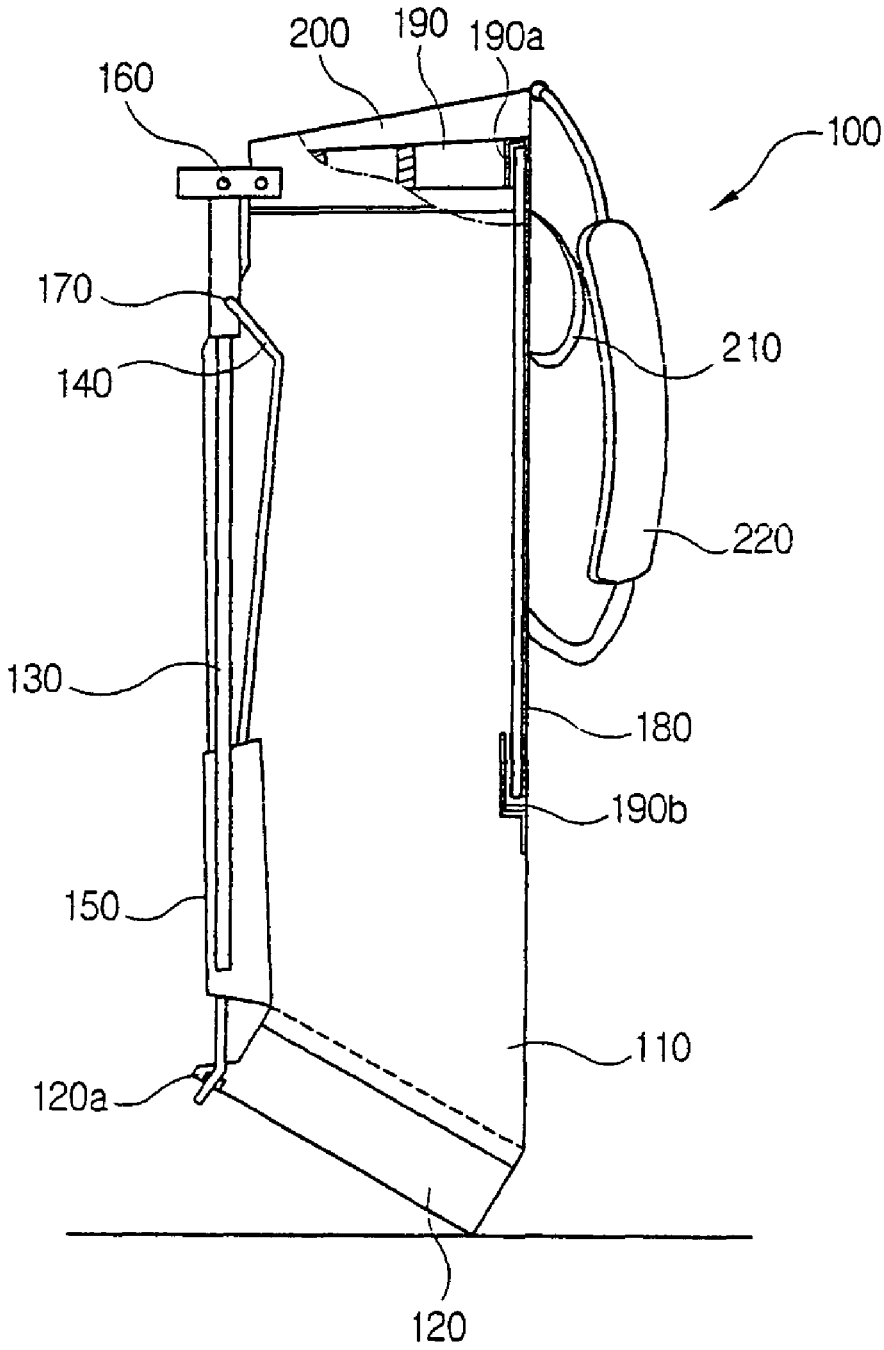
FIG. 3 is a side view of the golf bag according to the present invention.
Figure 4:
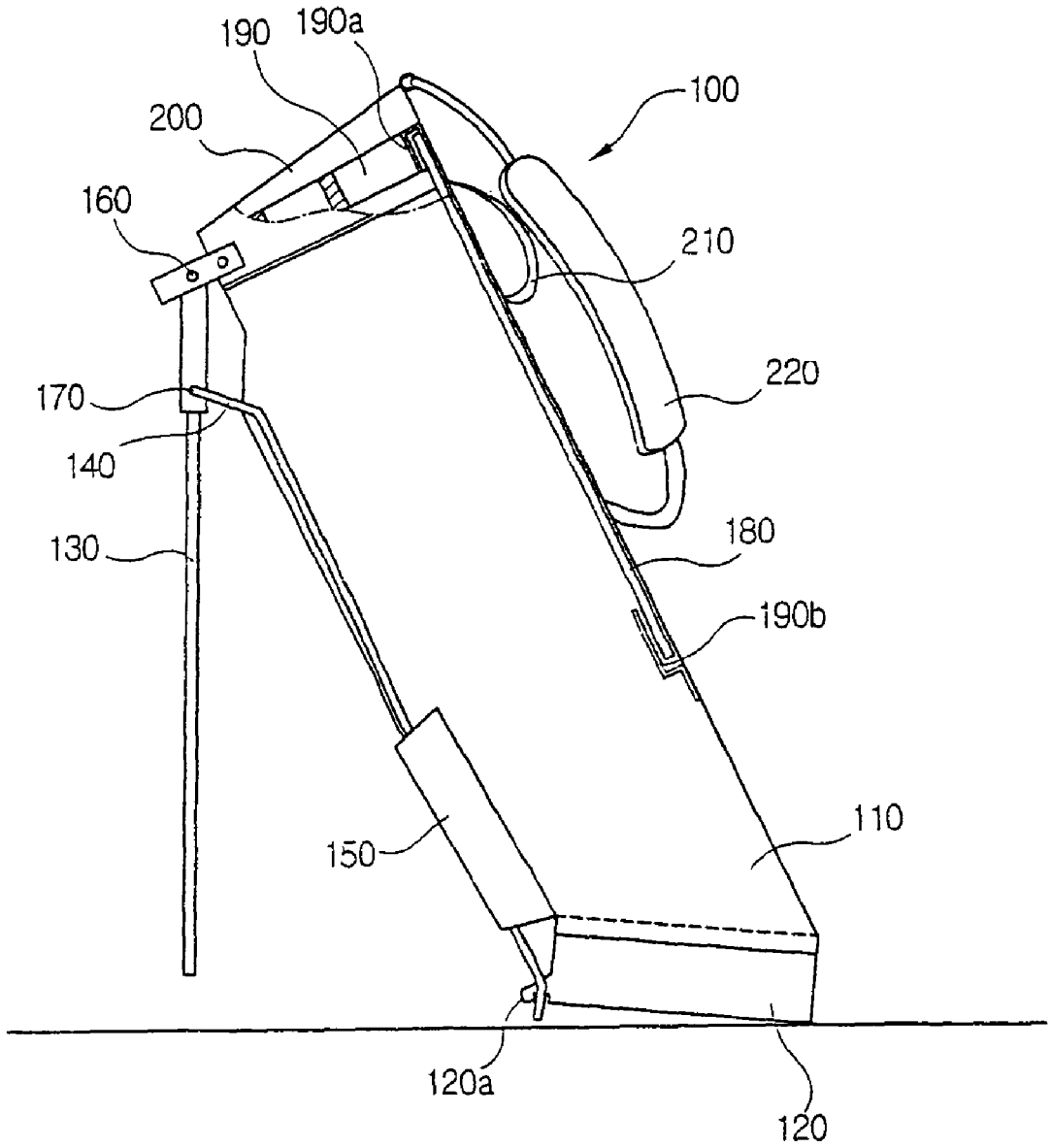
FIG. 4 is a side view of the golf bag according to the present invention, which is in an intermediate state in which the support legs of the golf bag are not fully extended and the lower end of the leg actuating arm is in a state just before coming into contact with the support surface during the rearward leaning motion of the golf bag.
Figure 5:
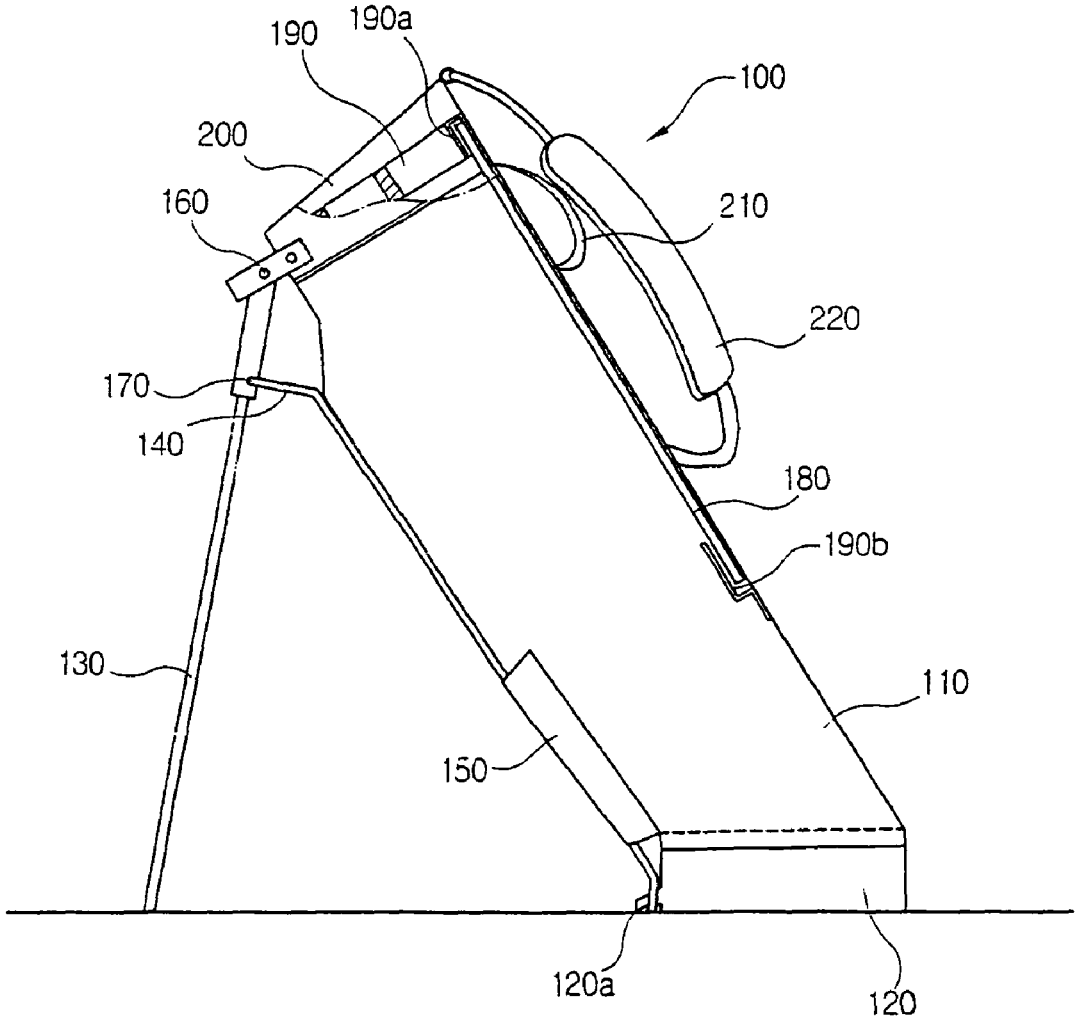
FIG. 5 is a side view of the golf bag according to the present invention, which is in a fully leaning state in which the support legs of the golf bag are fully extended and the lower surface of the bottom unit of the golf bag is in close contact with the support surface.
Figure 6:
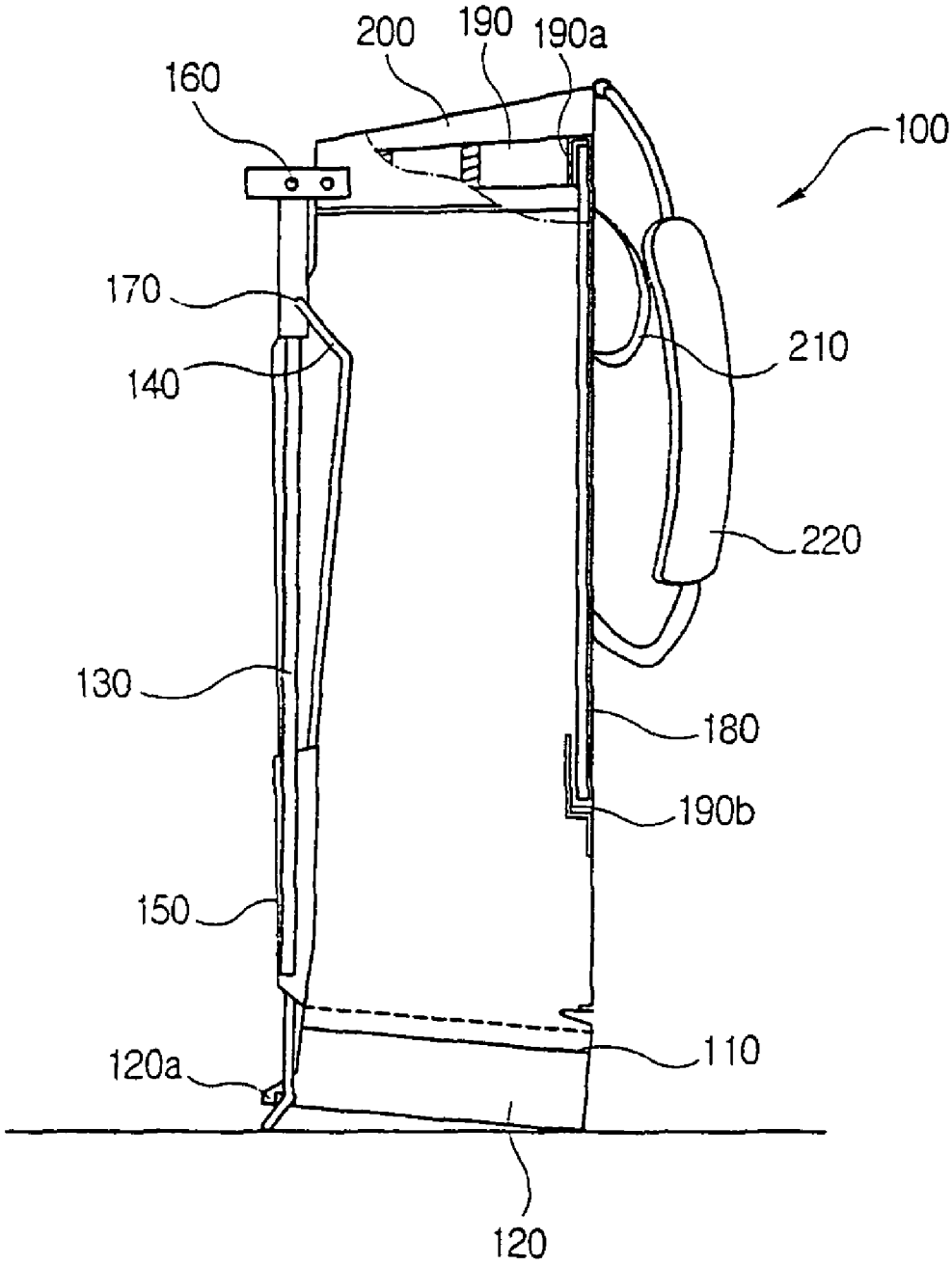
FIG. 6 is a side view of the golf bag according to the present invention, which is in an upright state in which the golf bag stands almost upright on the support surface, with the lower surface of the bottom unit being above and slightly spaced apart from the support surface.

FIG. 1 is a side view of a golf bag according to the present invention, which is in an intermediate state in which a pair of support legs of the golf bag is not fully extended, but the lower end of a leg actuating arm comes into contact with a support surface while the golf bag is leaning rearwards. FIG. 2A is a perspective view of a bottom unit of the golf bag according to the present invention. FIG. 2B is a sectional view of the bottom unit of the golf bag according to the present invention. FIG. 3 is a side view of the golf bag according to the present invention. FIG. 4 is a side view of the golf bag according to the present invention, which is in an intermediate state in which the support legs of the golf bag are not fully extended and the lower end of the leg actuating arm is in a state just before coming into contact with the support surface during the rearward leaning motion of the golf bag. FIG. 5 is a side view of the golf bag according to the present invention, which is in a fully leaning state in which the support legs of the golf bag have been fully extended and the lower surface of the bottom unit of the golf bag is in close contact with the support surface. FIG. 6 is a side view of the golf bag according to the present invention, which is in an upright standing state in which the golf bag stands almost upright on the support surface, with the lower surface of the bottom unit being slightly spaced above the support surface.

In the drawings, the reference numeral 100 denotes a golf bag. The golf bag 100 comprises a bag body 110, with both a handle 210 and a shoulder strap 220 mounted to the front part of the bag body 110. A leg support bracket is provided on the rear part of the top of the bag body 110. A pair of support legs 130 is rotatably coupled by a hinge 160 to the leg support bracket of the bag body 110. A leg actuating arm 140 is rotatably coupled by a hinge 170 to the upper ends of the support legs 130 so as to extend or collapse the legs 130. The lower end of the bag body 110 is diagonally inclined rearwards and upwards. The upper end of the bag body 110 is provided with a cuff 200, and a head 190 is placed inside the cuff 200 in a conventional manner.

In the golf bag 100, the lower end of the bag body 110 is diagonally inclined forwards and downwards, and a bottom unit 120 is attached along the diagonally inclined lower end of the bag body 110 such that the bottom unit 120 is diagonally inclined relative to the axis of the bag body 110.

A front support rib 180, which has a length shorter than the length of each of the front and rear parts of the bag body 110, is installed in the front part of the bag body 110 such that the upper end of the front support rib 180 is held in a rib support hole 190*a* provided in the front part of the head 190 of the bag body 110. The lower end of the front support rib 180 is held in a rib support piece 190*b*, which is provided in the front part of the bag body 110.

Furthermore, the bottom unit 120, which is attached along the diagonally inclined lower end of the bag body 110 such that the bottom unit 120 is diagonally inclined relative to the axis of the bag body 110, is provided with a hook protrusion 120*a*, which is formed on the lower part of the outer surface of the rear part of the bottom unit 120. An arm holding flap 150 is attached to the rear part of the bag body 110 at a predetermined position so as to hold the lower part of the leg actuating arm 140, which is operated to extend or collapse the support legs 130.

As described above, the bottom unit 120 is diagonally mounted to the inclined lower end of the bag body 110 such that the golf bag 100 leans rearwards when the bag 100 is put down on a support surface. Therefore, if the golf bag 100 is vertically placed on a support surface, the golf bag 100 leans rearwards and can be supported on the support surface by the support legs 130 in the rearward leaning state. Described in detail, when the golf bag 100 leans rearwards on the support surface, the leg actuating arm 140, which is made of resilient steel and is held at the lower part thereof by the arm holding flap 150 attached to the lower part of the rear part of the bag body 110, elastically tensions both the lower part of the bag body 110 and the arm holding flap 150, so that the lower part of the bag body 110 and the arm holding flap 150 can be maintained in the tensioned state without becoming rumpled or collapsed.

Furthermore, the front support rib 180 is configured as a rib having a length shorter than the length of each of the front and rear parts of the bag body 110 such that the lower end of the support rib 180 cannot reach the inner surface of the bottom unit 120 or the lower end of the bag body 110. Furthermore, the lower end of the bag body 110 is diagonally inclined forwards and downwards, and the bottom unit 120 is attached along the diagonally inclined lower end of the bag body 110 such that the bottom unit 120 is diagonally inclined relative to the axis of the bag body 110. Thus, the bag body 110 can be maintained in an extended state while the bottom unit 120 is in surface contact with a support surface. If the lower end of the bag body 110 is located in a horizontal state relative to the support surface, the horizontality starts from the lower rear part of the bottom unit 120, which comprises the support legs 130. Thus, the front support rib 180, which is installed in the front part of the bag body 110 having the handle 210, is configured such that the rib 180 has a length shorter than the length of the rear part of the bag body 110 having the support legs 130.

When the support legs 130 are fully extended, the leaning angle of the golf bag 100 on a support surface varies according to the length of the leg actuating arm 140. Thus, to maintain a desired leaning angle of the golf bag 100 when the bag 100 leans rearwards on a support surface, it is necessary to adjust the length of the leg actuating arm 140 and, at the same time, to limit the range of motion of the leg actuating arm 140, which pushes the support legs 130 rearwards. If the range of motion of the leg actuating arm 140 to push the support legs 130 is not limited in the state in which the length of the leg actuating arm 140 has been adjusted to an appropriate length, the golf bag 100 may excessively lean on the support surface. Thus, to limit the moving range of the leg actuating arm 140 within a predetermined range, a hook protrusion 120*a* is formed on the lower part of the outer surface of the rear part of the bottom unit 120, which is attached along the diagonally inclined lower end of the bag body 110 of the golf bag 100 such that the bottom unit 120 is diagonally inclined relative to the axis of the bag body 110. When the leg actuating arm 140 moves upwards and pushes the support legs 130 rearwards, the U-shaped lower end of the leg actuating arm 140 is hooked by the hook protrusion 120*a*, so that the moving range of the leg actuating arm 140 can be limited.

In a conventional technique, when assuming that the bottom unit is perpendicular to the bag body, the bottom unit may be attached to the lower end of the bag body so as to form an angle of 90 degrees with the axis of the bag body or to form an angle of 180 degrees with the lower end of the bag body.

However, unlike the conventional technique, the present invention is configured such that the bottom unit 120 neither forms an angle of 90 degrees relative to the axis of the bag body 110 nor forms an angle of 180 degrees relative to the lower end of the bag body 110. The bottom unit 120 of the present invention is preferably attached to the lower end of the bag body 110 at an angle of inclination greater than the leaning angle of the bag body 110, which is supported on a support surface by the fully extended support legs 130, as shown in FIG. 5.

In other words, the angle of inclination of the bottom unit 120 attached to the lower end of the bag body 110 is greater than the leaning angle of the golf bag 100, which is supported in a leaning state thereof on a support surface by the support legs 130.

When the golf bag 100 leans on a support surface and the lower ends of the support legs 130 come into contact with the support surface, the bag body 110 having the bottom unit 120 is not folded or collapsed. However, after the lower ends of the support legs 130 have come into contact with the support surface in the state in which the bag body 110 is extended, the golf bag 100 is preferably raised in the opposite direction at an angle equal to the difference between the angle of inclination of the bottom unit 120 attached to the lower end of the bag body 110 and the leaning angle of the golf bag 100 on the support surface. Thus, the lower part of the bag body 110 of the golf bag 100, which leans on a support surface, is prevented from folding or collapsing.

The golf bag having the bottom unit diagonally attached to the lower end of the bag body according to the present invention is operated as follows.

The golf bag 100 of the present invention has the construction shown in FIG. 3. As shown in FIG. 3, the front support rib 180 is installed in the front part of the bag body 110 such that the rib 180 does not reach the inner surface of the bottom unit 120. Thus, when the golf bag 100 is put down on a support surface, the front part of the bottom unit 120 associated with the handle 210 comes into contact with the support surface prior to the rear part of the bottom unit 120 due to the weight of the golf clubs, golf balls and other necessities stored in the golf bag 100. Thereafter, when the golf bag 100 is pushed into an almost upright position thereof at which the lower surface of the bottom unit 120 comes into almost horizontal contact with the support surface, as shown in FIG. 6, the lower end of the front part of the bag body 110 having the handle 210 is folded and collapsed with wrinkles. In the above state, the lower surface of the bottom unit 120 may come into horizontal contact with the support surface. However, because the lower end of the leg actuating arm 140 extends to a location below the lower surface of the bottom unit 120, the golf bag 100 can stand upright on the support surface while the bottom unit 140 is in the inclined state thereof. In the above state, if the front support rib 180 installed in the bag body 110 is longer such that the lower end of the rib 180 reaches the bottom unit 120 or the lower end of the bag body 110, the lower end of the front part of the bag body 110 may fail to be folded or collapsed with wrinkles. However, in the present invention, the front support rib 180 is shorter than each of the front and rear parts of the bag body 110, so that the lower end of the front part of the bag body 110 is preferably folded or collapsed with wrinkles, as shown in FIG. 6.

When a golfer puts the golf bag 100 down on a green as shown in FIG. 6 so as to place the golf bag 100 on the green in a rearward leaning state, the lower end of the leg actuating arm 140, which extends to a location below the lower surface of the bottom unit 120 attached to the lower end of the bag body 110 such that the bottom unit 120 is diagonally inclined relative to the axis of the bag body 110, first comes into contact with the ground surface of the green, so that the leg actuating arm 140 is biased upwards. Thus, the leg actuating arm 140, which is rotatably coupled by the hinge 170 to the upper ends of the two support legs 130, pushes the upper ends of the support legs 130 rearwards. Thus, the two support legs 130, which are rotatably coupled by the hinge 160 to the leg support bracket of the bag body 110, are opened outwards, so that the golf bag 100 can be stably supported in a rearward leaning state on the green by a three-point support structure formed by the two support legs 130 and the leg actuating arm 140.

When the golfer holds the golf bag 100 with one hand to move the golf bag 100, which has been supported in the rearward leaning state on the green, the leg actuating arm 140, which has elastically opened the two legs 130, restores the original state thereof due to elasticity. Thus, the leg actuating arm 140 pulls the two support legs 130, which are coupled by the hinge 170 to the leg actuating arm 140, so that the two support legs 130 are closed around the hinge 160 and come into close contact with the rear part of the bag body 110. The golf bag 100 with the collapsed legs 130 can be easily moved by the golfer while golfing.

The golf bag 100 according to the present invention may be supported in a rearward leaning state on a support surface as shown in FIG. 5, or may stand upright on a support surface as shown in FIG. 6.

As is apparent from the above description, the golf bag according to the present invention prevents the lower part of the rear part of the bag body from being folded or collapsed with wrinkles while the support legs are opened in the state in which the golf bag is leaning rearwards on the ground surface. Furthermore, when a golfer moves the golf bag while holding the bag with one hand or carrying the bag on one shoulder, the lower end of the leg actuating arm does not droop toward the ground surface. When the leg actuating arm comes into contact with the ground surface and, thereafter, pushes the hinged support legs rearwards to extend the legs outwards, the leg actuating arm limits the moving range of the legs, thereby preventing the legs from being excessively opened. Furthermore, because the lower surface of the bottom unit is in almost horizontal contact with the ground surface, the golf bag can be stably supported in a rearward leaning state on the ground surface, thus being convenient for a golfer to use. Therefore, the golf bag of the present invention is practical to use, so that the golf bag will be preferably used by golfers.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A golf bag, comprising:

a bag body having a lower end diagonally inclined rearwards and upwards;

a bottom unit attached along the diagonally inclined lower end of the bag body such that the bottom unit is diagonally inclined relative to an axis of the bag body, with a hook protrusion provided on a lower part of an outer surface of a rear part of the bottom unit;

a front support rib installed in a front part of the bag body such that an upper end of the front support rib is held in a rib support hole provided in a head of the bag body and a lower end of the front support rib is held in a rib support piece provided in the bag body;

a pair of support legs coupled to a rear part of the upper end of the golf bag;

a leg actuating arm coupled to the support legs so as to extend or collapse the legs; and an arm holding flap attached to the rear part of the bag body at a predetermined position so as to hold a lower part of the leg actuating arm, the front support rib, which is shorter than lengths of each of the front and rear parts, being installed in the front part of the bag body such that the upper end of the front support rib is held in the rib support hole provided inside the front part of the head of the bag body, the lower end of the front support rib is held in the rib support piece, and, when the golf bag is stood upright on a support surface, the lower end of the front part of the bag body is folded or collapsed with wrinkles.

2. The golf bag according to claim 1, wherein the lower end of the bag body is diagonally inclined forwards and downwards, and the bottom unit has a constant height, so that upper and lower ends of the bottom unit are parallel to each other, the bottom unit being attached along the diagonally inclined lower end of the bag body such that the bottom unit is diagonally inclined relative to the axis of the bag body.

3. The golf bag according to claim 1, wherein the leg actuating arm is rotatably coupled by a hinge to upper ends of the support legs such that the leg actuating arm is in close contact with the rear part of the bag body, the leg actuating arm being covered to be held at the lower part thereof in the arm holding flap attached to the rear part of the bag body.

4. The golf bag according to claim 1, wherein the front support rib, which is installed in the front part of the bag body, has a length determined such that the lower end of the front support rib is located at a position higher than a rear end of the inclined lower end of the bag body or such that the length of the front support rib is shorter than a length of the front part of the bag body.

5. The golf bag according to claim 1, wherein the pair of support legs is coupled by a hinge to the rear part of the upper end of the golf bag, and a lower end of the leg actuating arm is formed as a U-shaped end and is hooked by the hook protrusion provided on the rear part of the bottom unit, so that, when the support legs are extended and opened around the hinge by the leg actuating arm, which comes into contact with a support surface, the legs are prevented from being excessively extended or opened.

6. A golf bag, comprising:

a bag body having a lower end continuously diagonally inclined rearwards and upwards from a front part of the bag body to a rear part of the bag body;

a bottom unit attached along the diagonally inclined lower end of the bag body such that the bottom unit is diagonally inclined relative to an axis of the bag body, with a hook protrusion provided on a lower part of an outer surface of a rear part of the bottom unit;

a front support rib installed in the front part of the bag body such that an upper end of the front support rib is held in a rib support hole provided in a head of the bag body and a lower end of the front support rib is held in a rib support piece provided in the bag body;

a pair of support legs coupled to a rear part of the upper end of the golf bag;

a leg actuating arm coupled to the support legs so as to extend or collapse the legs; and an arm holding flap attached to the rear part of the bag body at a predetermined position so as to hold a lower part of the leg actuating arm.

7. The golf bag according to claim 6, wherein the lower end of the bag body is diagonally inclined forwards and downwards, and the bottom unit has a constant height, so that upper and lower ends of the bottom unit are parallel to each other, the bottom unit being attached along the diagonally inclined lower end of the bag body such that the bottom unit is diagonally inclined relative to the axis of the bag body.

8. The golf bag according to claim 6, wherein the leg actuating arm is rotatably coupled by a hinge to upper ends of the support legs such that the leg actuating arm is in close contact with the rear part of the bag body, the leg actuating arm being covered to be held at the lower part thereof in the arm holding flap attached to the rear part of the bag body.

9. The golf bag according to claim 6, wherein the front support rib, which is installed in the front part of the bag body, has a length determined such that the lower end of the front support rib is located at a position higher than a rear end of the inclined lower end of the bag body or such that the length of the front support rib is shorter than a length of the front part of the bag body.

10. The golf bag according to claim 6, wherein the pair of support legs is coupled by a hinge to the rear part of the upper end of the golf bag, and a lower end of the leg actuating arm is formed as a U-shaped end and is hooked by the hook protrusion provided on the rear part of the bottom unit, so that, when the support legs are extended and opened around the hinge by the leg actuating arm, which comes into contact with a support surface, the legs are prevented from being excessively extended or opened.

* * * * *